United States Patent [19]

Miller

[11] Patent Number: 4,768,442

[45] Date of Patent: Sep. 6, 1988

[54] CRANE APPARATUS

[75] Inventor: John F. Miller, Howell, Mich.

[73] Assignee: Phillips Industries, Inc., Dayton, Ohio

[21] Appl. No.: 914,145

[22] Filed: Oct. 1, 1986

[51] Int. Cl.[4] ..... E01B 25/22

[52] U.S. Cl. ..... 104/106; 104/94

[58] Field of Search ..... 403/344; 24/580; 104/94, 106, 107, 108, 109, 111

[56] References Cited

U.S. PATENT DOCUMENTS

| | | | |
|---|---|---|---|
| 650,746 | 5/1900 | Barney | 104/111 |
| 2,195,644 | 4/1940 | Fitzgerald et al. | 403/344 X |
| 3,101,677 | 8/1963 | Ehinger | 104/94 X |
| 3,265,011 | 8/1966 | Golden | 104/106 X |
| 3,310,003 | 3/1967 | Bryan | 104/94 |
| 3,422,508 | 1/1969 | Higuchi | 24/580 X |
| 3,974,777 | 8/1976 | Monne | 104/94 |
| 4,393,785 | 7/1983 | Hortnagel | 104/111 X |
| 4,576,096 | 3/1986 | Toder | 104/94 |
| 4,619,545 | 10/1986 | Kuttenbaum | 403/344 X |
| 4,628,719 | 12/1986 | Best | 104/94 X |

FOREIGN PATENT DOCUMENTS

| | | | |
|---|---|---|---|
| 1576944 | 8/1969 | France | 104/94 |
| 778931 | 7/1957 | United Kingdom | 104/111 |

*Primary Examiner*—Peter A. Aschenbrenner
*Assistant Examiner*—James R. Brittain
*Attorney, Agent, or Firm*—Bertram F. Claeboe

[57] ABSTRACT

Overhead crane apparatus is disclosed incorporating an extruded aluminum alloy rail structure for runway and bridge girder applications. The relatively light weight and low cost rail structure is shaped to provide a trolley passageway protected from the ingress of deleterious substances, and is further contoured to provide a shaped cavity for ready reception of novel clamp means facilitating the imposition of increased loads on existing crane apparatus. The rail structure during the extrusion process may also be formed with fluid passages in the side walls thereof.

2 Claims, 4 Drawing Sheets

FIG.3
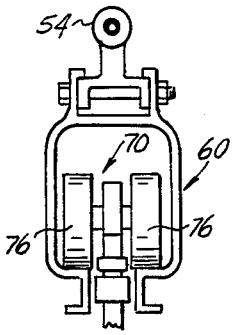
FIG.6
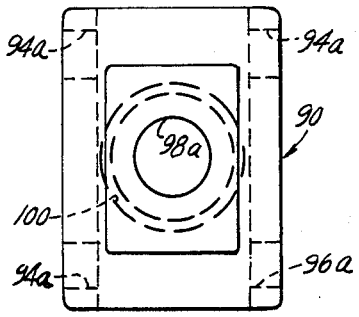
FIG.8
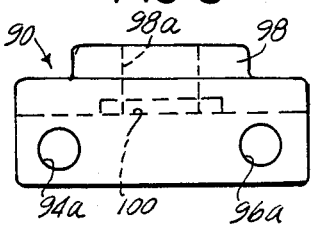
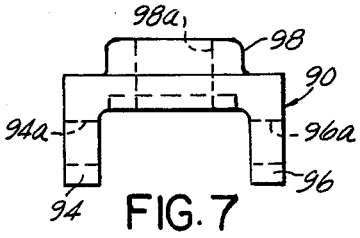
FIG.7
FIG.4
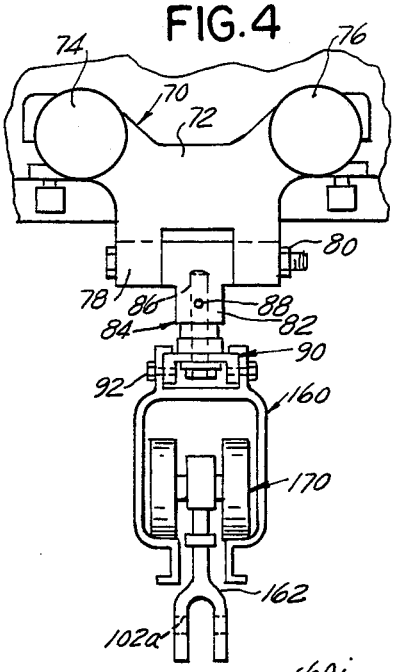
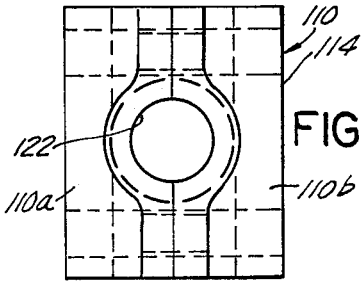
FIG.10
FIG.11
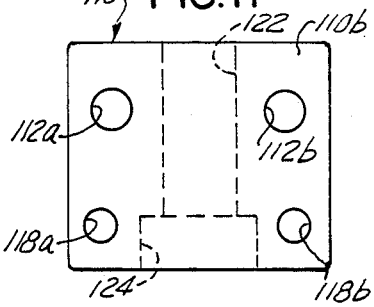
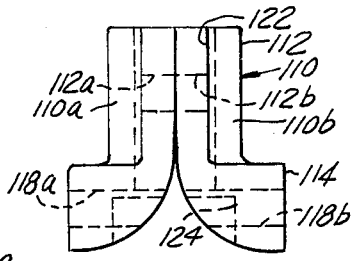
FIG.9
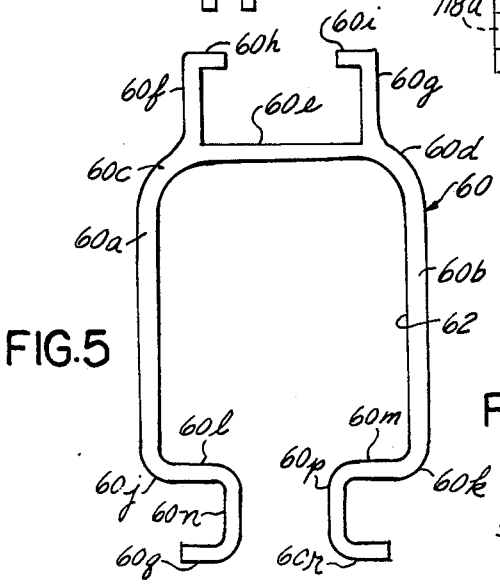
FIG.5
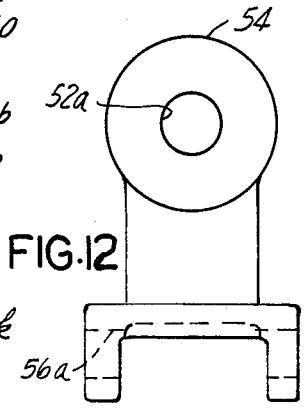
FIG.12
FIG.13
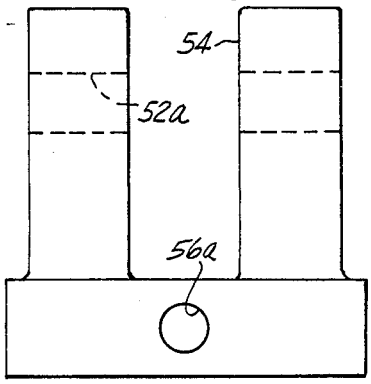

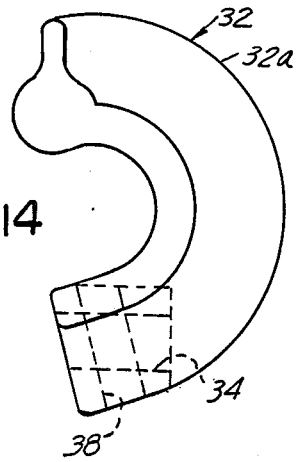
FIG. 14
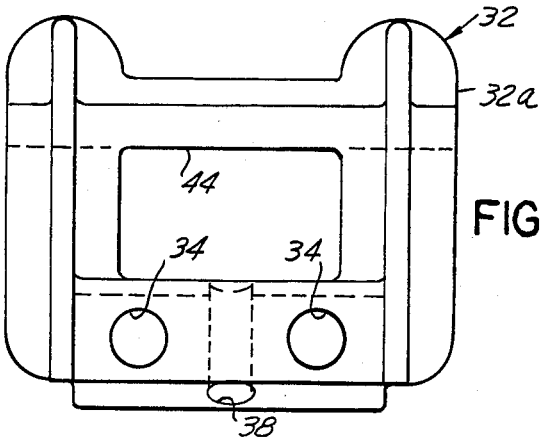
FIG. 15
FIG. 16
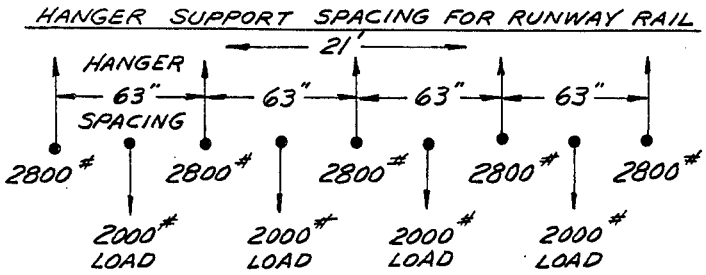
FIG. 17
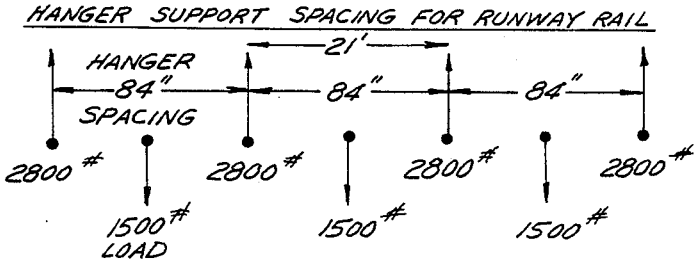
FIG. 18
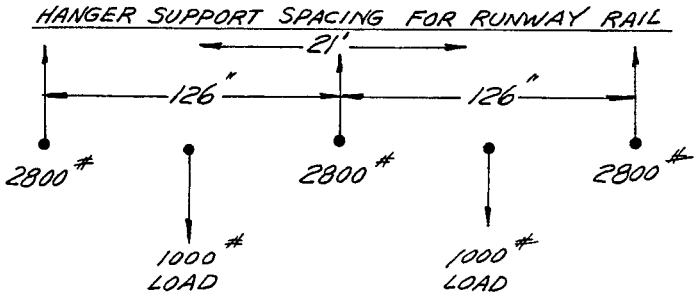

FIG. 19
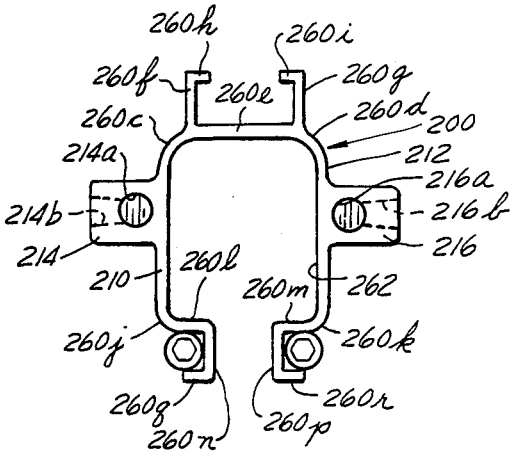
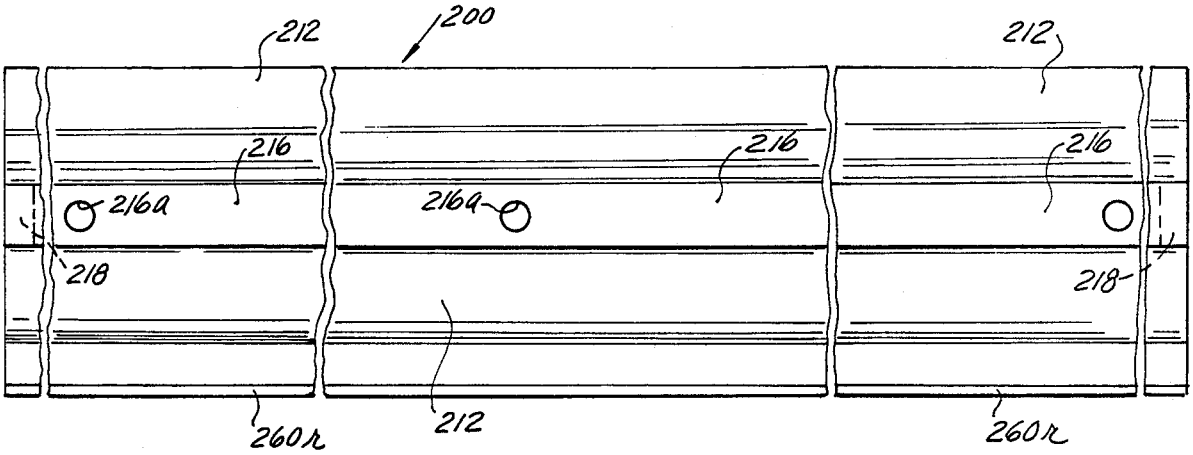
FIG. 20

CRANE APPARATUS

BACKGROUND OF THE INVENTION

It is known in the overhead crane art to which the present invention particularly appertains to construct the runway rails and bridge girders of steel, with attendant cost, weight and operational disadvantages. More specifically, and notwithstanding foreign competition, steel of the structural type commands what some regard as premium prices. Related thereto is the fact that many products requiring transport by overhead cranes during the manufacture thereof are presently of relatively lesser weight, exemplified in the automotive industry by the substitution of aluminum or plastics for steel. Cost and weight penalties accordingly characterize the utilization by the prior art of steel for runway rails and bridge girders or transfer beams.

It is also known that in the overhead crane art that the runway rails and bridge girders present in cross-section what are termed flange flat track or "I" beam configurations. In some environments this creates the problem of deleterious substances such as rust or foreign objects coming in contact with the trolley and related mechanisms. It has accordingly been proposed to utilize track sections of channel-like configuration formed of confronting half-sections of steel welded at their junctures. Again, the earlier noted cost and weight disadvantages subsist.

It is further the current practice in the crane art to employ trolleys wheels constructed of steel which travel upon steel runway rails and steel bridge girders. This presents a relatively high intensity sound level, which when combined with other noises common to a production line operation, may produce a decible rating approaching the average pain level.

SUMMARY OF THE INVENTION

Applicant has discovered that each of the foregoing disadvantages of known crane structures is effectively overcome by provision of a uniquely contoured unitary rail structure, preferably formed of aluminum by extrusion techniques and especially suited for use in overhead cranes as runway rails and/or bridge girders or transfer beams. The rail structure of this invention is precisely shaped to provide a pair of spaced parallel wall portions integrated at one of their ends by a connecting web portion, opposed ends of which are unitary with a pair of opposed short length wall portions terminating in opposed tab or flange portions to define with the web portion a readily accessible clamp-receiving cavity functioning uniquely in a manner to be later more fully described.

The opposite ends of the spaced wall portions of the present rail structure during the extrusion process connect with inwardly directed shelf or base portions integral with spaced parallel by portions terminating in outwardly directed foot portions. By so contouring the base, leg and foot portions, a passage is not only provided for insertion and removal of the trolley structure, but a generally U-shaped flange section is provided for fastening means permitting rapid connection of abutting ends of lengths of rail structure in order to increase crane capacity.

It is also within the purview of this invention to provide a novel clamp member structurally and functionally cooperating with applicant's innovative extruded rail structure, and which permits in a rapid and efficient manner an increase in the load or total superimposed weight on the load block or hook. Additionally, the present invention encompasses within the scope thereof an even further improved form of rail structure wherein extruded passages are provided in the spaced parallel wall portions for connection to a fluid source, such as compressed air, eliminating thereby a network of hoses which constitute an impairment to workmen efficiency. These and other inventive features will be more fully disclosed as the description proceeds particularly when taken in connection with the accompanying drawings.

BRIEF DESCRIPTION OF THE DRAWINGS

FIG. 3 is a detail view of a more permanent form of hanger structure as applied to the extruded rail of this invention;

FIG. 4 is a detailed view of a portion of crane apparatus, showing more fully an adapter assembly for a bridge girder;

FIG. 5 is a detail end view of the rail structure of this invention showing the significant contours thereof;

FIGS. 6, 7 and 8 are detail views which show more fully a sub-assembly of the adapter assembly of FIG. 4;

FIGS. 9, 10 and 11 are detail views of applicant's novel clamp structure shown in FIG. 1 in association with a runway rail as more fully illustrated in FIG. 5;

FIGS. 12 and 13 are detail views showing more fully the substantially permanent hanger structure of FIG. 3;

FIGS. 14 and 15 are detail views which show a clamp construction for attachment to an "I" beam or the like;

FIGS. 16, 17 and 18 are schematic diagrams portraying the efficacy of reduced hanger spacing on load for a given runway rail length, effectively showing thereby the improved results obtainable through applicant's rail and clamp combination illustrated particularly in FIGS. 5 and 9;

FIG. 19 is an end view of a modified form of rail structure provided with axially extending passaged protrusions for connection to a fluid source exemplified by compressed air; and FIG. 20 is a side elevational view taken substantially along the line 20—20 of FIG. 19.

DESCRIPTION OF THE PREFERRED EMBODIMENT

Figure 2:
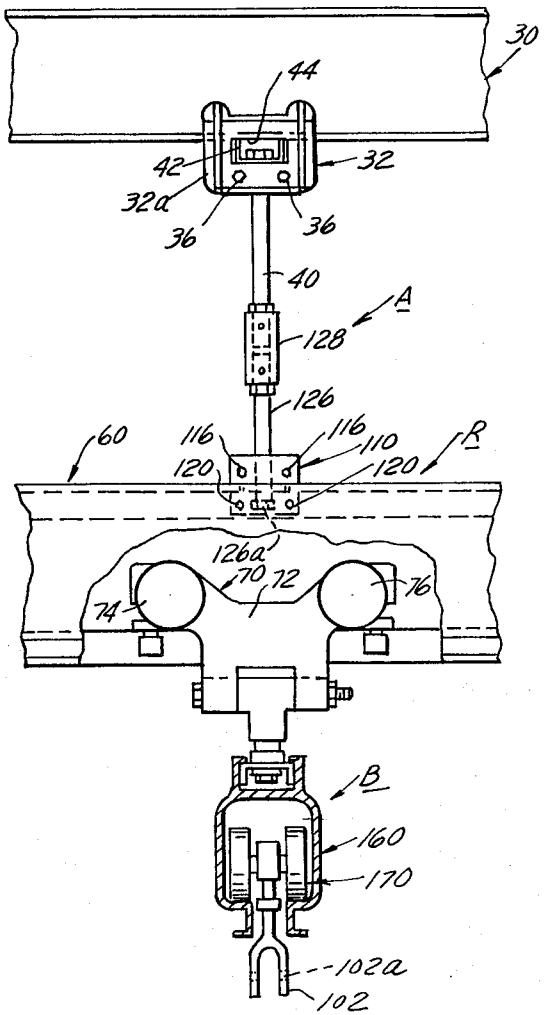
FIG. 2 is a partially fragmented side elevational view taken substantially along the line 2—2 of FIG. 1, a portion thereof being shown in section.
Figure 1:
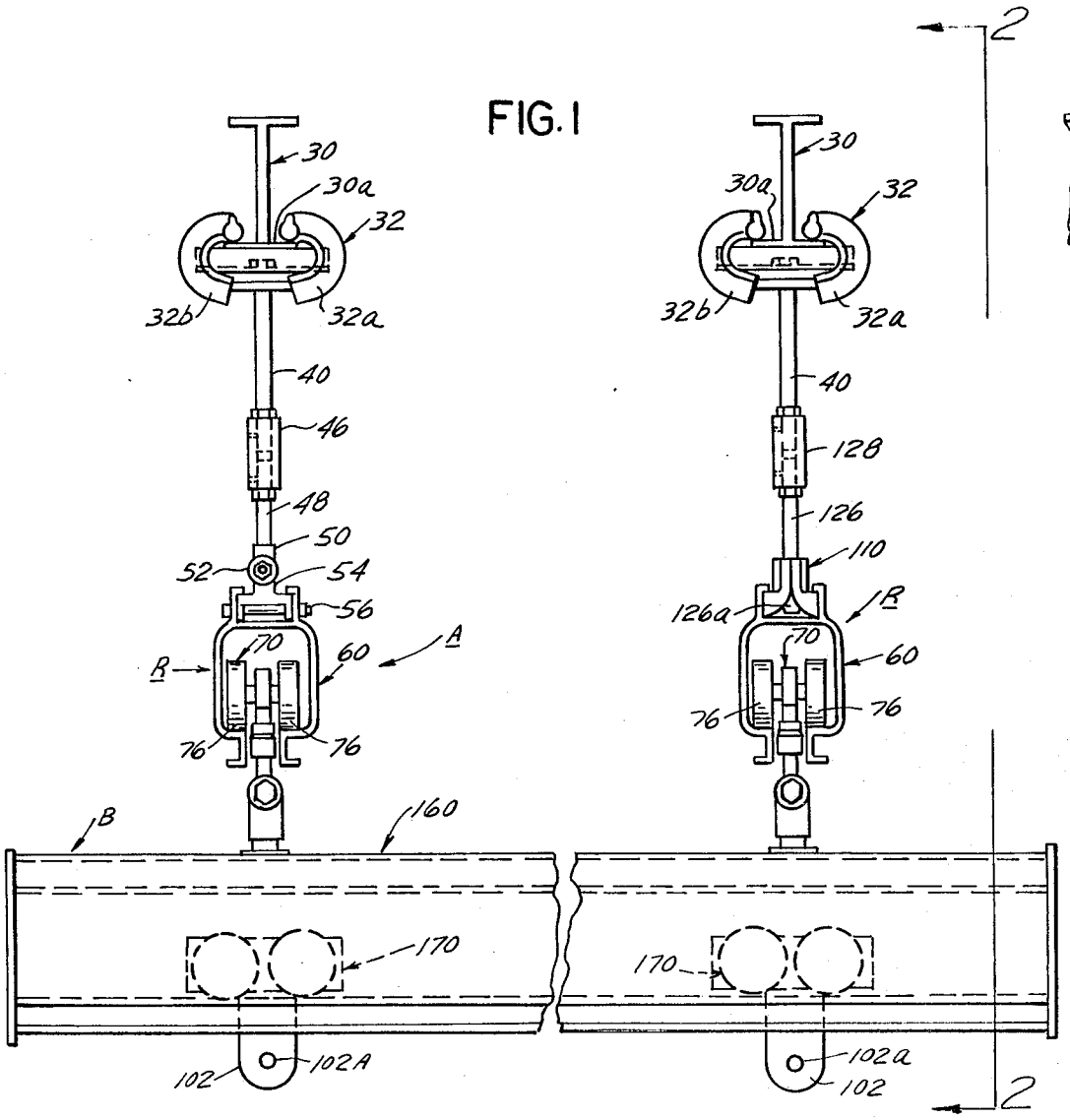
FIG. 1 is a partially fragmented end elevational view of crane apparatus constructed in accordance with the principles of this invention.

Referring now to the drawings, there is shown in FIGS. 1 and 2 crane apparatus designated in its entirety by the legend A. Crane apparatus A comprises basically runway structure generally indicated at R and bridge structure designated in its entirety by the legend B. Structures A and B are suspended from and connected to fixed structure (not shown) which normally is the upper support framework of a building, and illustratively the suspension means may take the form of transversely-spaced and longitudinally extending generally horizontal "I" beams 30, lower flange 30*a* of which is engaged by rail clamp means 32 having generally the configuration shown in detail in FIGS. 14 and 15. As appears therein, rail clamp means 32 is comprised of a pair of essentially identical generally arcuately-shaped clamp segments or halves 32*a* and 32*b*, each of which along its lower portion is transversely apertured at 34 to receive clamp segment fastening means 36 (FIG. 2). Each segment is further generally vertically passaged at 38 for receiving connecting means 40 generally taking the form of nut and bolt means as shown. If desired, the connection between the "I" beam lower flange 30*a* and connecting means 40 may be effected through a generally U-shaped transversely extending bracket member 42 (FIG. 2) disposed in central opening 44 in the clamp segments 32*a* and 32*b* and threadably receiving connecting means 40.

Referring now particularly to the left-hand portion of FIG. 1, connecting means 40 may have threadably associated therewith turnbuckle means 46 cooperating with an additional connecting means 48 mounting a passaged yoke member 50 bolted or otherwise secured at 52 to a pair of spaced hanger members 54 in turn bolted or otherwise affixed at 56 to runway rail generally designated as 60. As is shown in FIGS. 12 and 13, hanger members 54 are passaged at 52*a* to receive bolt means 52, and are apertured at 56*a* to receive bolt means 56.

A significant feature of the present invention is the structure and configuration of the runway rail 60. However, it is significant to note at this point that the construction of the novel rail herein disclosed has application to both runways and bridge girders or transfer beams, and accordingly, the description now to follow directed to rail 60 relates also to bridge girder 160 with like suffixes applied thereto. Unitary or non-segmented rail structure 60 of FIG. 5, to which reference is now made, is preferably provided by an extrusion process and is constructed of an aluminum alloy composition, producing thereby a relatively lightweight, high strength seamless shape of unitary wall structure. Aluminum alloys found suitable for this porpose are identified as "6061-T6" and "6005-T5" by Aluminum Standards and Data, 1979, a recognized text on the subject. These particular alloys are of course exemplary only, and the novel objects of this invention may be accomplished by variations therein.

The extruded rail 60 of FIG. 5 comprises a pair of spaced parallel side wall portions 60*a* and 60*b* connecting with smoothly rounded shoulder portions 60*c* and 60*d* joined by a connecting web or shelf portion 60*e*. At generally the junctures of the shoulder portions 60*c* and 60*d* and opposed ends of the web portion 60*e*, the shape of rail 60 is further defined by a pair of spaced parallel relatively short length wall portions 60*f* and 60*g* formed at their extremities with inwardly directed opposed flange portions 60*h* and 60*i*, respectively. As earlier noted, the web portion 60*e*, wall portions 60*f* and 60*g*, and flange or tab portions 60*h* and 60*i* provide a clamp-receiving cavity having a novel function to be described shortly.

The extruded rail 60 in the opposite end region thereof is characterized by generally rounded shoulder portions 60*j* and 60*k* connecting with the opposed side wall portions 60*a* and 60*b*, respectively, which are unitary with inwardly directed shelf or base portions 60*l* and 60*m* integrated with spaced parallel leg portions 60*n* and 60*p* and terminating in outwardly directed foot portions 60*q* and 60*r*. It can be recognized from the foregoing description when taken in connection with FIG. 5 and views related thereto that applicant has provided a novel extruded rail structure 60 having significant advantages over the prior art. Not only are marked savings effected in the cost and weight areas, but the web portion 60*e* and connecting extruded wall portions provide a passageway or tunnel 62 which is essentially closed to the ingress of deleterious substances, such as dirt and the like common to a manufacturing environment. The trolley (not shown in FIG. 5) is thus well-protected and possible malfunctioning reduced. Other features will be noted hereinafter.

Reverting now to FIGS. 1 to 4, normally traveling within tunnel or passageway 62 defined by the novel configuration of extruded rail 60 is trolley assembly 70. The assembly 70 essentially comprises a carriage 72 of generally Y-shaped configuration when viewed in side elevation (FIG. 4), the carriage 72 suitably supporting for rotation a plurality of pairs of wheels 74 and 76 which travel horizontally along the inwardly directed shelf or base portions 60*l* and 60*m* of extruded rail 60. The wheels 74 and 76, which may vary in numbers as applications require, are desirably constructed of plastics, exemplified by nylon, which in combination with aluminum alloy as the rail material, substantially reduces the noise factor and wear of the parts.

The carriage 72 of the trolley assembly 70 is further shaped to provide a bifurcated portion 78 to which is bolted or otherwise secured as at 80 yoke portion 82 of connector assembly generally designated 84. Yoke portion 82 of connector assembly 84 is passaged to threadably receive bolt means 86 or the like, which may be pinned as at 88, the bolt means 86 effecting securement of adapter means 90 connected as at 92 to bridge girder rail 160, earlier noted as having essentially the same novel configuration as runway rail 60 described in detail in connection with FIG. 5.

Adapter means 90 is shown in detail in FIGS. 6, 7 and 8, and as seen in the end view of FIG. 7, is substantially U-shaped. The adapter means 90 is preferably formed by casting to the shape shown and is provided with a pair of leg portions 94 and 96 passaged as at 94*a* and 96*a* to receive fastening means 92. The adapter means 90 is further shaped to include head portion 98 passage as at 98*a* to receive bolt means 86 connected to yoke portion 82 of the connector assembly 80. The adapter means 90 may further be provided with cavity 100 generally centrally of its body portion to receive bearing means (not shown).

It will be appreciated that the trolley assembly employed in connection with the bridge girder or transverse beam 160 may have substantially the same configuration as the trolley assembly 70 shown in association with the runway rail 60. Accordingly, like numerals raised by the integer "100" has been applied to like parts. However, differences in load and other factors may cause some differences between the trolley assemblies 70 and 170. In any event, trolley assembly 170 connects with a yoke number 102 apertured as at 102*a* for supporting hoisting mechanism (not shown) in a manner well-known to the art.

It is believed now quite apparent when reference is made to the left-hand portion of FIG. 1, particularly when note is also taken of FIGS. 3, 12 and 13, that the yoke member 50 and hanger members 54 and other structures directly associated therewith is of especial utility in an initial installation of the total overhead crane apparatus at the job site. This arises from the fact that the hanger members 54 at one end thereof form with the wall portions 60*e–i* what may be termed a "tongue and groove" connection, and accordingly, it is generally only expedient to install the hanger members 54 from one end of the runway rail 60. The problem which might be thus created should it be desired to support heavier loads from the bridge girders will better be understood when reference is made to the schematic diagrams of FIGS. 16, 17 and 18.

In these views a runway rail length of 21 feet is portrayed, the rail being extruded of one of the aluminum alloys earlier noted and having a wall thickness of approximately 0.250 inches. The "I" beam and related structure is assumed capable of supporting 2800 pounds at predetermiend locations therealong in each of FIGS. 16, 17 and 18. When the hanger supports, referring to the connecting means 40 and associated supporting means, are horizontally spaced a distance of about 126 inches, the bridge girders should not be expected to support a load greater than 1000 pounds each. FIGS. 17 and 16 illustrate how this load can be substantially increased by decreasing the distance between the hanger supports.

In addition to the above-enumerated advantages of applicant's novel rail structure shown in detail in FIG. 5 and identified therein generally by the numeral 60, the unique rail configuration of this invention permits the ready installation of additional hanger supports without interference with the crane framework as originally installed. Stated otherwise, hanger supports can be added to an existing runway rail without changing the positioning or location of the rail. Clamp structure particular effective for this purpose is shown in place in the right-hand portion of FIG. 1, appears in FIG. 2, and is shown in detail in FIGS. 9, 10 and 11. Clamp means as illustrated therein is designated generally by the numeral 110, and comprise a pair of mating essentially identical clamp half-portions 110*a* and 110*b*. Since the halves 110*a* and 110*b* are of like configuration, like numerals are employed to designate like parts throughout the same.

Each clamp portion is provided with head and base sections 112 and 114, respectively, the head sections 112 being passaged at 112*a* and 112*b* to receive bolt means on the like 116, and the base sections 114 being apertured at 118*a* and 118*b* to receive bolt means or the like 120 securing the clamp means 110 to wall portions 60*f* and 60*g* of runway rail 60 (FIG. 5). Each head section 112 is centrally grooved so as to provide an axially extending passage 122 when the clamp half-portions 110*a* and 110*b* are positioned face to face as in FIGS. 9 and 10. Each base section 114, on the other hand, is interiorly contoured so as to provide a cavity 124 when the clamp half-portions 110*a* and 110*b* are in abutment, wherein is seated head portion 126*a* (FIGS. 1 and 2) on bolt means or the like 126 threadably associated with turnbuckle means 128.

It can now be seen that with the runway rail 60 in a fixed or rigid position, it is relatively simple to hand manipulate the clamp half-portions 110*a* and 110*b* within the opening defined by the wall portions 60*e*, 60*f*, 60*g*, 60*h* and 60*i* of the extruded rail 60. When so positioned, the clamp base section end walls abut against the inner surfaces of the rail wall portions 60*f* and 60*g*, and the upper or top walls of the clamp base sections 114 bear against the flange or tab portions 60*h* and 60*i* of the runway rail 60. A firm connection is thereby made, and the important objectives portrayed in FIGS. 16, 17 and 18 accomplished without interference with fixed structure or the necessity of installing additional crane apparatus to accomodate heavier loads.

The extruded aluminum rail structure of this invention, particularly as applied to bridge girders, is well adapted to variations in the side wall configuration thereof so as to provide readily accessible conduit means for the transmission of compressed fluids conventionally employed in manufacturing processes. In this manner interference in the immediate work area from entangling hoses and related equipment is substantially reduced, and more rapid and reliable connections made to the compressed fluid source.

With reference now to the drawings, there is shown in FIGS. 19 and 20 and designated in its entirety by the numeral 200 an extruded rail structure embodying this novel aspect of the present invention. Except with respect to structural variations in its opposed side walls extruded aluminum alloy rail 200 corresponds in configuration to rail 60 of FIG. 5. Accordingly, like parts in FIGS. 19 and 20 carry the same identification as in FIG. 5, raised by the integer "200".

Rail structure 200 is formed during the extrusion process with opposed spaced parallel disposed and horizontally extending side walls 210 and 212, each formed substantially centrally between rounded shoulder portions 260*c*, 260*d*, 260*j* and 260*k* with outwardly and axially extending protrusions 214 and 216, respectively. The protrusions or protruberances 214 and 216 constitute projections from the rail side walls 210 and 212, respectively, and each is axially passaged at 214*a* and 216*a* to provide a generally round opening extending horizontally therethrough. Plug means 218 are threadably or otherwise associated with the opposed or terminal ends of the passages 214*a* and 216*a* for the purpose to be shortly described.

The axially extending protruberances 214 and 216 are also transversely passaged as at 214*b* and 216*b* at predetermined locations along the horizontal length thereof. Illustratively, on an extruded aluminum alloy rail 200 having a length of approximately 21 feet, the protruberances 214 and 216 may be transversely passaged approximately 6 inches inwardly from opposite ends thereof and also generally centrally of their axial lengths. These exemplary locations may of course vary substantially depending upon operational circumstances. The transversely directed passages 214*b* and 216*b* communicate at predetermined locations with axially extending passages 214*a* and 216*a*, respectively, and preferably are tapered as shown for ease of connection to compressed air-actuated apparatus (not shown) being utilized by an operator. The connector means may take various forms, and illustratively may be provided by a coupling with four "O" rings at the joining splices, and in this same regard, the connector means of this character may be provided with a countersunk stop at one end only thereof.

It is believed manifest from the foregoing that applicant has provided a novel extruded rail structure for crane apparatus featuring significant cost, weight and energy savings, and as well, being characterized by a relatively low decibel rating and low inertia of load. It is further to be noted that the present invention also features clamp means in association with the novel rail structure which permits substantial increases in the bridge crane load supporting capabilities in a cost savings manner. Various changes and modifications to these and other features of the instant invention have been disclosed herein, and other variations may of course be effected without departing from the spirit of the invention or the scope of the subjoined claims.

I claim:

1. A seamless extruded unitary alluminum alloy rail structure for use as runway rails and bridge girders in overhead crane applications, said rail structure being of channel-like configuration having an inverted generally U-shaped cross-section in end view, the legs of said U-shape during the extrusion process being continuously formed with horizontally extending protrusions passaged longitudinally therethrough to provide a conduit for connection to a compressed fluid source, each of said protrusions at predetermined locations therealong being transversely apertured to provide a fluid flow path from said conduit to a device utilizing compressed fluid for the operation thereof.

2. Clamp means for use with an extruded rail structure having spaced wall portions inwardly turned at one end thereof and a connecting wall at opposite ends to define a cavity for receiving and anchoring said clamp means, which comprises a pair of mating clamp sections each of which includes a base portion and wall portion generally right angularly disposed therefrom, each wall portion generally centrally of its opposite ends being formed with a semi-circular cavity providing a central opening for bolt means or the like when the clamp sections are assembled in mating face-to-face relation, and each base portion on the inner surface thereof being smoothly curvilinearly tapered for ease of installation of the clamp sections, said sections upon positioning within the clamp-receiving cavity of said rail structure being in close fitting contact with the spaced wall portions, inwardly turned wall portions, and connecting wall defining said cavity.

* * * * *